US011261569B2

(12) United States Patent
Lai

(10) Patent No.: US 11,261,569 B2
(45) Date of Patent: Mar. 1, 2022

(54) AUTOMATIC MOLDING MACHINE FOR MOLDED PRODUCT, MANUFACTURING METHOD, AND FINISHED PRODUCT

(71) Applicant: Deluxe Environmental Technology (Shanghai) Co., Ltd., Shanghai (CN)

(72) Inventor: Zong-Shen Lai, Yilan (TW)

(73) Assignee: Deluxe Environmental Technology (Shanghai) Co., Ltd., Shanghai (CN)

( * ) Notice: Subject to any disclaimer, the term of this patent is extended or adjusted under 35 U.S.C. 154(b) by 727 days.

(21) Appl. No.: 16/089,574

(22) PCT Filed: Mar. 28, 2016

(86) PCT No.: PCT/CN2016/000172
§ 371 (c)(1),
(2) Date: Sep. 28, 2018

(87) PCT Pub. No.: WO2017/165986
PCT Pub. Date: Oct. 5, 2017

(65) Prior Publication Data

US 2019/0119858 A1 Apr. 25, 2019

(51) Int. Cl.

| | |
|---|---|
| ***D21J 5/00*** | (2006.01) |
| ***D21J 3/00*** | (2006.01) |
| ***D21J 7/00*** | (2006.01) |
| ***D21J 3/10*** | (2006.01) |

(52) U.S. Cl.
CPC . *D21J 5/00* (2013.01); *D21J 3/00* (2013.01); *D21J 3/10* (2013.01); *D21J 7/00* (2013.01)

(58) Field of Classification Search
USPC ..... 162/416
See application file for complete search history.

(56) References Cited

U.S. PATENT DOCUMENTS

| | | | | |
|---|---|---|---|---|
| 6,210,531 | B1 * | 4/2001 | Bradford | B29C 43/56 162/218 |
| 6,352,617 | B1 * | 3/2002 | Lee | D21J 7/00 162/218 |
| 9,783,928 | B2 | 10/2017 | Zheng et al. | |
| 2005/0150624 | A1 * | 7/2005 | Toh | D21B 1/00 162/218 |
| 2015/0292154 | A1 * | 10/2015 | Zheng | D21F 9/04 162/226 |

(Continued)

FOREIGN PATENT DOCUMENTS

| | | | |
|---|---|---|---|
| CN | 102995502 | A | 3/2013 |
| CN | 204690510 | U | 10/2015 |

(Continued)

*Primary Examiner* — Mark Halpern
(74) *Attorney, Agent, or Firm* — Alan D. Kamrath; Karin L. Williams; Mayer & Williams PC

(57) ABSTRACT

An automatic molding machine for a molded product, a manufacturing method and a finished product includes an upper pulp suction mold and a lower pulp suction mold configured to simultaneously suck the pulp in a pulp box, wherein the molds are closed and formed into a formed blank which becomes the finished product of the molded product after dehydration, hot pressing and shaping. Advantages include speeding up manufacturing, increasing the thickness of the finished product, increasing the shock absorption effect, and making an excellent surface.

5 Claims, 16 Drawing Sheets

(56) References Cited

U.S. PATENT DOCUMENTS

| | | | | |
|---|---|---|---|---|
| 2016/0168793 | A1* | 6/2016 | Kuo | D21J 3/00<br>162/227 |
| 2019/0119858 | A1 | 4/2019 | Lai | |

FOREIGN PATENT DOCUMENTS

| | | | |
|---|---|---|---|
| CN | 204898440 | U | 12/2015 |
| CN | 205576636 | U | 9/2016 |
| JP | 6741783 | B2 | 8/2020 |
| TW | I612199 | B | 1/2018 |
| WO | WO2005012640 | A1 | 2/2005 |

* cited by examiner

AUTOMATIC MOLDING MACHINE FOR MOLDED PRODUCT, MANUFACTURING METHOD, AND FINISHED PRODUCT

BACKGROUND OF INVENTION

This application is a 371 of PCT/CN2016/000172 filed 28 Mar. 2016.

FIELD OF THE INVENTION

The present invention relates to an automatic molding machine for a molded product, a manufacturing method and a finished product, and more particularly, to an automatic molding machine and manufacturing method and finished product, in which an upper pulp suction mold and a lower pulp suction mold simultaneously sucks the pulp in a pulp box, and the molds are closed and formed into a formed blank, which becomes the molded product after dehydration, hot pressing and shaping. Advantages include speeding up the manufacturing speed, increasing the thickness of the finished product, increasing the shock absorption effect, and making an excellent surface.

DESCRIPTION OF RELATED ART

In the early days, many industrial products and household products were made of plastic materials. Later, it was found in research that products made of plastic materials have the potential to release toxins, which cause serious pollution to the environment, are difficult to recycle and reuse, or are difficult to recycle and treat. The cost of treatment is so large, etc., because of the large number of plastic products, which has caused serious damage to global environmental protection for many years. In the era of high environmental awareness, it is important to research and search for non-toxic and easily recycled materials, which is the mainstream of practical applications. At present, there have been developed products in which paper pulp and/or plant fiber materials are mixed into a pulp material, which is sucked by a suction mold, pressed and molded with an extrusion die, and then subjected to hot pressing forming technology. The name of "molded product" or "paper-plastic product" is clearly distinguished from "plastic product" in terms and definitions. "Molded products" are easy to recycle, remanufacture and reuse. They are in line with the trend of energy saving and carbon reduction for environmental protection. Therefore, they are quickly valued and accepted by the business community and the general public. Molded products are often seen, for example, in: bowls, plates, cup lids, packaging materials, shock absorber materials, pad materials, etc. and are gradually adopted.

The conventional "molded product" must be manufactured through two processes of "sucking and molding" and "hot pressing and shaping", wherein, the process of "sucking and shaping" is made up of a fine metal mesh provided in a surface, a suction mold opened with numerous suction holes which are connected to a suction device; when the suction mold is pushed and lowered into a pulp box filled with pulp by external power (e.g. a power cylinder), the pulp in the pulp box is vacuum-pumped by the suction device through the pumping holes to adsorb the pulp on the outer surface of the fine metal mesh to form a pulp layer; after the mold suction is full, it is driven to rise off the pulp box, and at the same time, the pulp layer on the outer surface of the fine metal mesh gradually reduces the humidity due to continuous suction, and then the external power drives the suction mold to rise and overturn together with the pulp layer, close the mold with an extrusion mold, extrude (press) the pulp layer to reduce humidity and simultaneously mold it into a "formed blank", and then the suction mold adsorbs the formed blank to leave the extrusion mold, then stop the adsorption of the formed blank, and the formed blank is taken away from the suction mold by another vacuum adsorption force, the manufacturing process of "sucking and molding" is completed.

Then, the process of "hot pressing and shaping" is carried out. It is known that there are two common types of hot pressing and shaping, and the first type of formed blank is when the water content drops to about 55-70%, that is, the hot pressing and shaping device (including the crimping mold and heating equipment) directly perform hot pressing and shaping operation on the formed blank, the hot pressing temperature is between 150° C.±10° C., the hot pressing time depends on the volume of the molded product, this is called a "wet pressing method"; the second type of formed blank is firstly heated and dried when the water content drops to about 55-70%. When the water content is reduced to about 7-10%, the hot pressing and shaping equipment (including the crimping mold and heating equipment) carries out the hot pressing and shaping of the formed blank, the hot pressing temperature is between 150° C.±10° C., but the hot pressing time will be shorter than the "wet pressing method", which is called a "dry pressing method". Therefore, it can be seen that the formed blank completed by the suction molding process is equal to the shape but it contains partial humidity and it is not shaped before the hot pressing and shaping process has been performed, that is, the formed blank is that a pulp layer is not so wet and the molded product is not so dry, so it must be heated and pressurized by the hot pressing and shaping process, so that the formed blank can be shaped into the finished product of the molded product.

The present inventor specializes in the manufacture of molded products. Through long-term experience in contact with molded products, it is recognized that there are many improvements in the manufacture and use of molded products, and the conventional manufacturing methods are relatively lacking as follows:

1. As mentioned above, the suction is started by the suction mold via the suction device, and then the wet reduction action of the pulp layer after the suction mold leaves the pulp box is also carried out by the suction device, and one side of the pulp layer (the side attached to the fine metal mesh) can be vacuumed and dehumidified only by the suction device, so the dehumidification state of the pulp layer cannot be the same, and the side faced with the fine metal mesh is dehumidified faster, the side deviated from the fine metal mesh is dehumidified slower, resulting in a slower overall dehumidification speed, which lowers the manufacturing speed and affects the finished product output.

2. The suction mold is a single individual mold, the shape of the surface is set, and finally the molded product of the same shape is formed. Because the suction mold adopts vacuum pumping force to suck the pulp, the single pulp layer can only be made, the disposable single layer covers the outer surface of the fine metal mesh, and the multiple pulp layers cannot be stacked. Therefore, it is generally only suitable for small products (such as bowls, plates, cup lids, etc.) which are relatively smooth in appearance and do not need to be too thick in thickness. If you want to make a thicker product (for example, a packaging material with better shock absorber effect), the conventional manufacturing method is still difficult to achieve. Therefore, it is common to use molded products as packaging materials. The molded shock absorber materials (possibly of the same material or different materials) can be used to gain shock absorption. It is not possible to achieve both packaging and shock absorption in a single molded product.

3. Generally, the pulp layer is closely adhered to and covers the fine metal mesh on average, so that the fine metal mesh is made of fine mesh with fine fineness, so that the surface of the formed blank which is pressed by the fine metal mesh appears fine "excellent surface" to be flat; then when the pulp layer and the extrusion mold are extrusion-shaped, the maximum effect of the extrusion mold is to extrude the pulp layer to reduce the humidity and quickly shape it into a formed blank, so based on cost considerations, the surface of the extrusion mold does not have an excellent fineness. Therefore, the surface of the formed blank which is pressed by the extrusion mold appears as a "non-excellent surface" to be a relatively uneven, so the conventional molded product will obviously show two surfaces that are excellent on one side and non-excellent on the other side. Conventional molded products are suitable for packaging non-high value products (such as packaged eggs), but when used to package high-value products (such as mobile phones), there will be "non-excellent surface" in the packaging materials of molded products, which will result in poor visual perception and lower the value of the overall goods.

Because the above-mentioned conventional molded products are slow in manufacturing speed, difficult in increasing the thickness, and lacking a smooth surface on the surface, the molded product is greatly limited in the promotion of use, and cannot be directly used for packaging valuable products.

SUMMARY OF THE INVENTION

In view of the above, the inventor has intensively conceived research and development improvements in order to solve the above-mentioned issues, and by a long period of efforts, the present invention has been produced.

So, the present invention mainly aims to provide an automatic molding machine for a molded product, manufacturing method and finished product which can speed up the manufacturing speed.

In addition, the present invention aims to provide an automatic molding machine for a molded product, manufacturing method and finished product which can increase the thickness of the finished product and the space for the shock absorber to benefit the shock absorber.

Also, the present invention mainly aims to provide an automatic molding machine for a molded product, manufacturing method and finished product which can make the surface appear as a smooth surface.

To achieve the above mentioned objectives, the present invention is related to an automatic molding machine for molded products, including: an upper pulp suction mold is erected on an upper frame and can be lifted and lowered by a first power device; the mold face of the upper pulp suction mold is facing downward, and the upper pulp suction mold is connected with a first pumping device, which can accept the pumping or blowing action of the first pumping device; a lower pulp suction mold is erected on an auxiliary frame, and the auxiliary frame is lifted and lowered together with the lower pulp suction mold by a second power device, and the mold face of the lower pulp suction mold is facing upward; the lower pulp suction mold is located under the upper pulp suction mold, and the lower pulp suction mold is connected with a second pumping device, which can accept the pumping or blowing action of the second pumping device; a pulp box is disposed under the lower pulp suction mold, the internal space is used for receiving the pulp, and the top opening is used for that the mold surface of the lower pulp suction mold and the mold surface of the upper pulp suction mold are immerged in the pulp; at least one lower hot pressing mold is erected on a lower frame, and can be laterally moved by a third power device, and the lower hot pressing mold is located at one side of the upper pulp suction mold, and the height of the lower hot pressing mold is between the upper pulp suction mold and the lower pulp suction mold, and when the lower hot pressing mold is pushed to move laterally, that is, it reaches at a corresponding position under the upper pulp suction mold, the lower hot pressing mold is connected with a third pumping device, which can accept the pumping or blowing action of the third pumping device; at least one upper hot pressing mold is erected on the upper frame, and can be lifted and lowered by a fourth power device, and the upper hot pressing mold is located at one side of the upper pulp suction mold and above the lower hot pressing mold, the upper hot pressing mold can be closed with the lower hot pressing mold when lowering, and the upper hot pressing mold is connected with a fourth pumping device, which can accept the pumping or blowing action of the fourth pumping device; and at least one receiving tray is located outside the lower hot pressing mold, and the receiving tray is erected with the lower hot pressing mold and can be pushed to synchronously move laterally.

According to above mentioned automatic molding machine for molded products, the first pumping device can blow the high pressure gas.

According to the above mentioned automatic molding machine for molded products, the first pumping device can blow the high pressure gas with high heat.

According to the above mentioned automatic molding machine for molded products, the upper pulp suction mold is internally connected with a liquid outlet pipe.

The present invention is further related to a method of manufacturing a molded product and the following steps are carried out:

(1) starting the second power device to drive down the auxiliary frame together with the lower pulp suction mold to be immerged into the pulp box;

(2) starting the first power device to drive the upper pulp suction mold to be immersed in the pulp box, and then starting the first pumping device and the second pumping device to generate a pumping effect, so that the mold surface of the upper pulp suction mold and the mold surface of the lower pulp suction mold simultaneously suck the pulp, so as to form a pulp layer respectively;

(3) when the pulp suction time is up, the upper pulp suction mold is closed with the lower pulp suction mold, so that the pulp layers which are respectively adsorbed by the upper pulp suction mold and the lower pulp suction mold are merged to form a formed blank, the formed blank thickness is greater than the thickness of the original single pulp layer;

(4) after the upper pulp suction mold is closed with the lower pulp suction mold to merge the two pulp layers into a formed blank, the second pumping device maintains a pumping action through the lower pulp suction mold, so as to adsorb the formed blank, but the first pumping device stops the pumping action, which is changed to a blowing action, to blow in a high pressure gas, so that the formed blank can be dehydrated;

(5) the second power device drives the lower pulp suction mold together with the upper pulp suction mold and the formed blank to rise, so that the mold surface of the lower pulp suction mold and the formed blank are separated from the pulp surface;

(6) when the dehydration time is up, the first pumping device stops the blowing action through the upper pulp suction mold, which is changed to a pumping action to adsorb the formed blank, while the second pumping device closes the pumping action through the lower pulp suction mold, which is changed to a blowing action, so that the formed blank is separated from the lower pulp suction mold; then, the first power device drives the upper pulp suction mold to adsorb the formed blank to rise together;

(7) the third power device is started to push the lower hot pressing mold to move laterally along the lower frame, which stops at a corresponding position under the upper pulp suction mold, while the receiving tray moves synchronously and laterally with the lower hot pressing mold to stop under the upper hot pressing mold;

(8) the first power device is started to push down the upper pulp suction mold to be closed with the lower hot pressing mold, and then the third pumping device generates the pumping action through the lower hot pressing mold, so as to adsorb the formed blank, while the first pumping device closes the pumping action through the upper pulp suction mold, which is changed to a blowing action, so that the formed blank is separated from the upper pulp suction mold;

(9) the upper pulp suction mold is driven to rise, so that the formed blank is adsorbed on the lower hot pressing mold, and the formed blank is continuously dehydrated and dehumidified during the process;

(10) the lower hot pressing mold is driven to move laterally along the lower frame to stop under the upper hot pressing mold, and the receiving tray is laterally moved back along with the lower hot pressing mold;

(11) the fourth power device is started to drive down the upper hot pressing mold to be closed with the lower hot pressing mold, and the formed blank is subjected to hot pressing and shaping, which is fully dehydrated into the finished product of the molded product; when the hot pressing and shaping time is up, the lower hot pressing mold and the upper hot pressing mold will stop heating, and then the fourth pumping device starts the pumping action through the upper hot pressing mold, so as to adsorb the finished product of the molded product, while the third pumping device starts a blowing action through the lower hot pressing mold, so that the finished product of the molded product is separated from the lower pulp suction mold;

(12) the upper hot pressing mold adsorbs the finished product of the molded product, both are collectively driven to rise back;

(13) when the receiving tray is driven to move relatively under the hot pressing upper mold, the fourth pumping device stops the pumping action through the upper hot pressing mold, which is changed to a blowing action, the finished product of the molded product is blown down and received by the receiving tray; and

(14) when the receiving tray is driven to move laterally outwards and back, the finished product of the molded product is driven outwards and then taken away and collected separately by the receiving tray.

According to the above mentioned method of manufacturing a molded product, after the upper pulp suction mold is closed with the lower pulp suction mold, the two pulp layers are merged into a formed blank, the high pressure gas blown by the first pumping device may be a high-heat and high-pressure gas to accelerate dehydration.

According to the above mentioned method of manufacturing a molded product, when the first power device drives the upper pulp suction mold to adsorb the formed blank and both rise together, the second power device drives down the lower pulp suction mold to be immerged into the pulp box.

According to the above mentioned method of manufacturing a molded product, the first pumping device of the upper pulp suction mold blows the high-pressure gas, so that when the formed blank begins to be dehydrated, the liquid inside the upper pulp suction mold is discharged via the liquid outlet pipe inside the upper pulp suction mold.

According to the above mentioned method of manufacturing a molded product, there are some similar shapes and positions in the pulp layers respectively adsorbed by the upper pulp suction mold and the lower pulp suction mold, and also there are some different shapes and positions.

According to the above mentioned method of manufacturing a molded product, when the pulp layers respectively adsorbed by the upper pulp suction mold and the lower pulp suction mold are merged into a formed blank, the parts with the same shape and position are laminated, and the parts with different shape and position are not laminated, which will produce a space.

The present invention is further related to a finished product of the molded product, wherein the finished product is manufactured by using an automatic molding machine of the molded product and applying the manufacturing method of the molded product.

According to the above mentioned finished product of the molded product, the finished product is shaped by hot-pressing the formed blank, and the formed blank is merged by the pulp layers respectively adsorbed by the upper pulp suction mold and the lower pulp suction mold, there are some similar shapes and positions in the pulp layers respectively adsorbed by the upper pulp suction mold and the lower pulp suction mold, and also there are some different shapes and positions.

According to the above mentioned finished product of the molded product, when the pulp layers respectively adsorbed by the upper pulp suction mold and the lower pulp suction mold are merged into a formed blank, the parts with the same shape and position are laminated, and the parts with different shape and position are not laminated, which will produce a space.

DETAILED DESCRIPTION OF THE PREFERRED EMBODIMENTS

In order to achieve the above objects, the technical means and the practical progress of the present invention are implemented, and the following preferred embodiments are described in detail with reference to the accompanying drawings.

The present invention distinguishes three parts of the automatic molding machine for a molded product, manufacturing method of the molded product and the finished product of the molded product, and the description is as follows.

Figure 1:
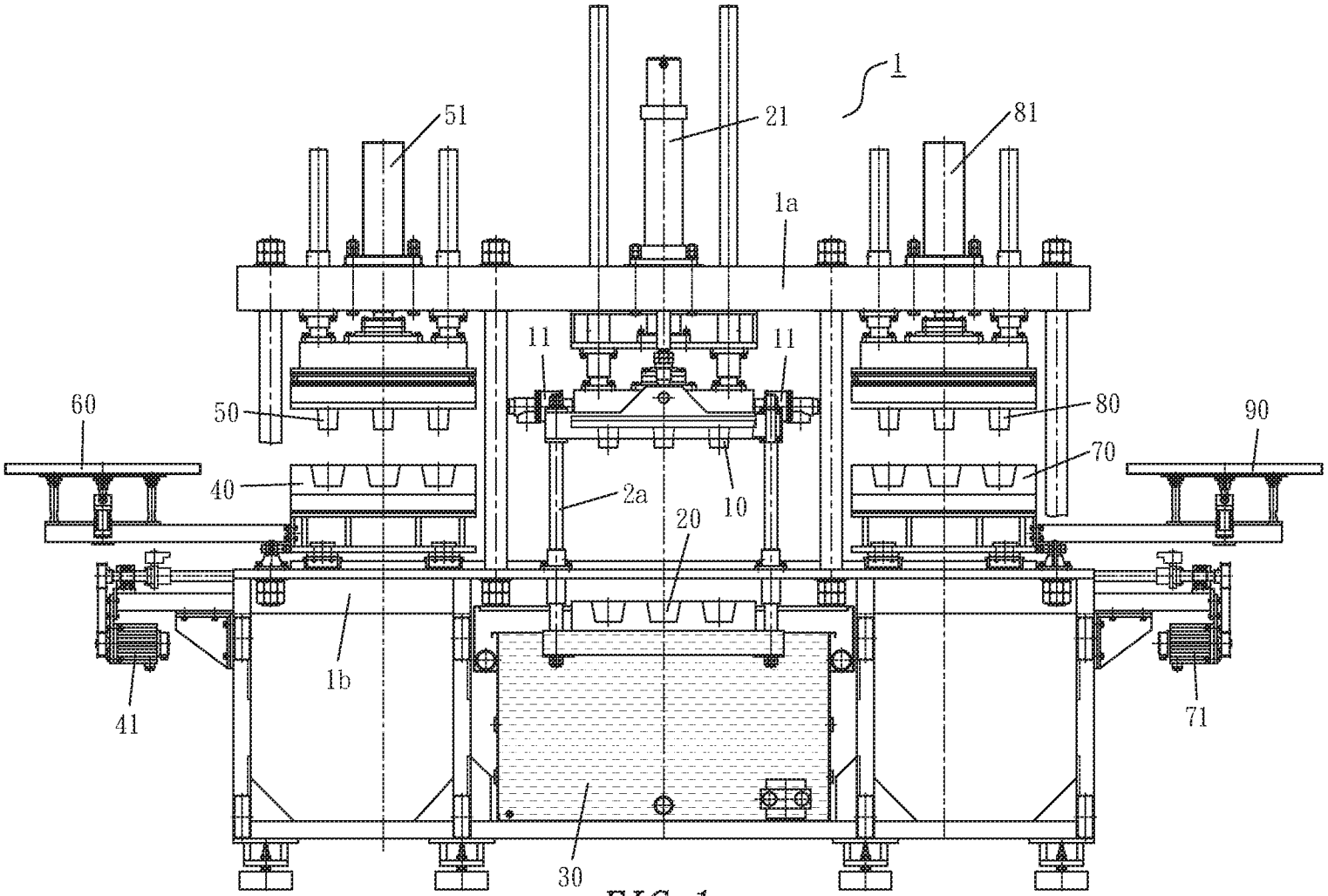
FIG. 1 is a schematic diagram of a structural composition of an automatic molding machine for a molded product of the present invention.

An overall structural composition of the "automatic molding machine for molded product" in the present invention is shown as FIG. 1, which is an automatic molding machine 1 suitable for manufacturing a molded product. The structural composition mainly includes:

A upper pulp suction mold 10 is erected on an upper frame 1*a*, and can be lifted and lowered by a first power device 11 (for example, a motor, but not limited thereto), and the upper pulp suction mold 10 faces downward, the upper pulp suction mold 10 is connected with a first pumping device (not shown), and can accept the pumping (vacuum) action or the blow (air supply) action of the first pumping device, and the upper pulp suction mold 10 is internally connected outwards with a liquid outlet pipe;

A lower pulp suction mold 20 is erected on an auxiliary frame 2*a*, and the auxiliary power frame 2*a* is driven up and down by a second power device 21 (for example, a hydraulic cylinder, but is not limited thereto), so that the lower pulp suction mold 20 can be lifted and lowered under this action, the lower pulp suction mold faces upward, and the lower pulp suction mold 20 is located under the upper pulp suction mold 10, and the lower pulp suction mold 20 is connected with a second pumping device (not shown in the figure), the pumping (vacuum) action or the blowing (air supply) action of the second pumping device can be accepted;

A pulp box 30 is disposed under the lower pulp suction mold 20, and the inner space is provided for the pulp mixed with paper pulp and/or plant fiber material, and the top opening of the pulp box 30 is available for the mold face of the lower pulp suction mold 20 and the mold face of the upper pulp suction mold 10 to be passed and immersed in the pulp;

A lower hot pressing mold 40 of first side is erected on the lower frame 1*b*, it can be laterally moved by a third power device 41 (for example, motor and roller arrangement, but not limited thereto), the lower hot pressing mold 40 of first side is located at one side of the upper pulp suction mold 10 (for example, the left side), and the height of the lower hot pressing mold 40 of first side is between the upper pulp suction mold 10 and the lower pulp suction mold 20. Therefore, when the lower hot pressing mold 40 of first side is pushed and laterally moved, the corresponding position under the upper pulp suction mold 10 can be reached, the lower hot pressing mold 40 of first side is connected with a third pumping device (not shown), which can accept the pumping (vacuum) action or the blowing (air supply) action of the third pumping device;

A upper hot pressing mold 50 of first side is erected on the upper frame 1*a*, it is driven up and down by a fourth power device 51 (for example, an oil hydraulic cylinder, but is not limited thereto), the upper hot pressing mold 50 of first side is located on one side of the upper pulp suction mold 10 (for example, the left side), and is located above the lower hot pressing mold 40 of first side, so the upper hot pressing mold 50 of first side can be closed with the lower hot pressing mold 40 of first side when lowering the upper hot pressing mold 50 of first side, and the upper hot pressing mold 50 of first side is connected with a fourth pumping device (not shown), which can accept the pumping (vacuum) action or the blowing (air supply) action of the fourth pumping device;

A receiving tray 60 of first side is located at the outer side of the lower hot pressing mold 40 of first side (for example, the left side), and the receiving tray 60 of first side is erected with the lower hot pressing mold 40 of first side to be pushed synchronously and moved laterally;

A lower hot pressing mold 70 of second side and the lower hot pressing mold 40 of first side are erected on the lower frame 1*b*, it can be pushed and moved laterally by a fifth power device 71 (for example, motor and roller arrangement, but not limited thereto). The lower hot pressing mold 70 of second side is located at the other side of the upper pulp suction mold 10 (for example, the right side), and the position height of the lower hot pressing mold 70 of second side is between the upper pulp suction mold 10 and the lower pulp suction mold 20, when the lower hot pressing mold 70 of second side is pushed and moved laterally, the position under the upper pulp suction mold 10 can be reached, and the lower hot pressing mold 70 of second side is connected with a fifth pumping device (not shown in the figure), which can accept the pumping (vacuum) action or the blow (air supply) action of the fifth pumping device;

A upper hot pressing mold 80 of second side and the upper hot pressing mold 50 of first side are erected on the upper frame 1*a*, it can be driven up and down by a sixth power device 81 (for example, oil hydraulic cylinder, but not limited thereto), the upper hot pressing mold 80 of second side is located at the other side (for example, the right side) of the upper pulp suction mold 10, and it is located above the lower hot pressing mold 70 of second side, so the upper hot pressing mold 80 of second side can be closed with the lower hot pressing mold 70 of second side when lowering the upper hot pressing mold 80 of second side, the upper hot pressing mold 80 of second side is connected with a sixth pumping device (not shown in the figure), which can accept the pumping (vacuum) action or the blow (air supply) action of the sixth pumping device;

A receiving tray 90 of second side is located at the outer side of the lower hot pressing mold 70 of second side (for example, the right side), and the receiving tray 90 of second side is erected with the lower hot pressing mold 70 of second side to be pushed synchronously and moved laterally.

The above structure composes an automatic molding machine 1, wherein, by the suction upper mold 10, the central portion of the overall automatic molding machine 1 is composed of the upper pulp suction mold 10, the lower pulp suction mold 20 and the pulp box 30; one side of the integral automatic molding machine 1 (for example, the left side) is composed of the lower hot pressing mold 40 of the first side, the upper hot pressing mold 50 of the first side and the receiving tray 60 of the first side; the other side of the overall automatic molding machine 1 (for example, the right side) is composed of the lower hot pressing mold 70 of the second side, the upper hot pressing mold 80 of the second side and the receiving tray 90 of the second side. It can be seen from the above description and the drawings that the composition of the lower hot pressing mold 40 of the first side, the upper hot pressing mold 50 of the first side and the receiving tray 60 of the first side is the same as the composition of the lower hot pressing mold 70 of the second side, the upper hot pressing mold 80 of the second side and the receiving tray 90 of the second side, but the existing position is symmetrically arranged (it can be seen from the figure), that is, one is the left side, and the other is the right side. The expected combined effect on the manufacturing steps (the manufacturing steps are detailed later) composed of the lower hot pressing mold 40 of first side, the upper hot pressing mold 50 of first side and the receiving tray 60 of the first side at the middle is produced for the different time course, thereby saving working time and increasing production capacity. Therefore, if only one setting is selected from the composition of the lower hot pressing mold 40 of the first side, the upper hot pressing mold 50 of the first side and the receiving tray 60 of the first side as well as the composition of the lower hot pressing mold 70 of the second side, the upper hot pressing mold 80 of the second side and the receiving tray 90 of the second side; and then co-located with the composition of the upper pulp suction mold 10, the lower pulp suction mold 20 and the pulp box 30 to be located centrally, and if this is the choice in the implementation of the present invention, it can be established in the implementation, so it is within the scope of the patent defined by the present invention.

Figure 2:
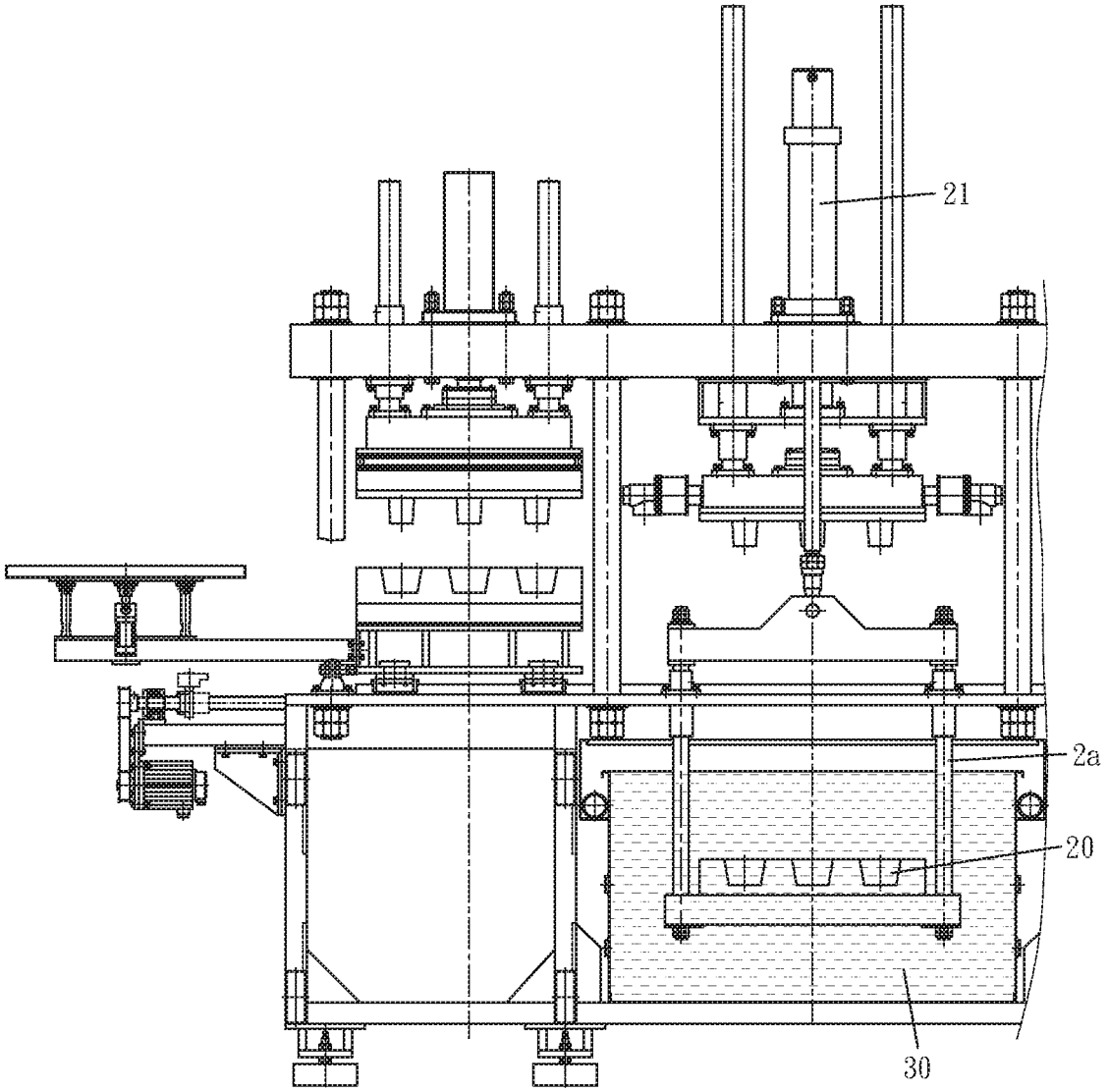
FIGS. 2-14 are schematic diagrams of continuous operation of the manufacturing method of the molded product of the present invention.
Figure 3:
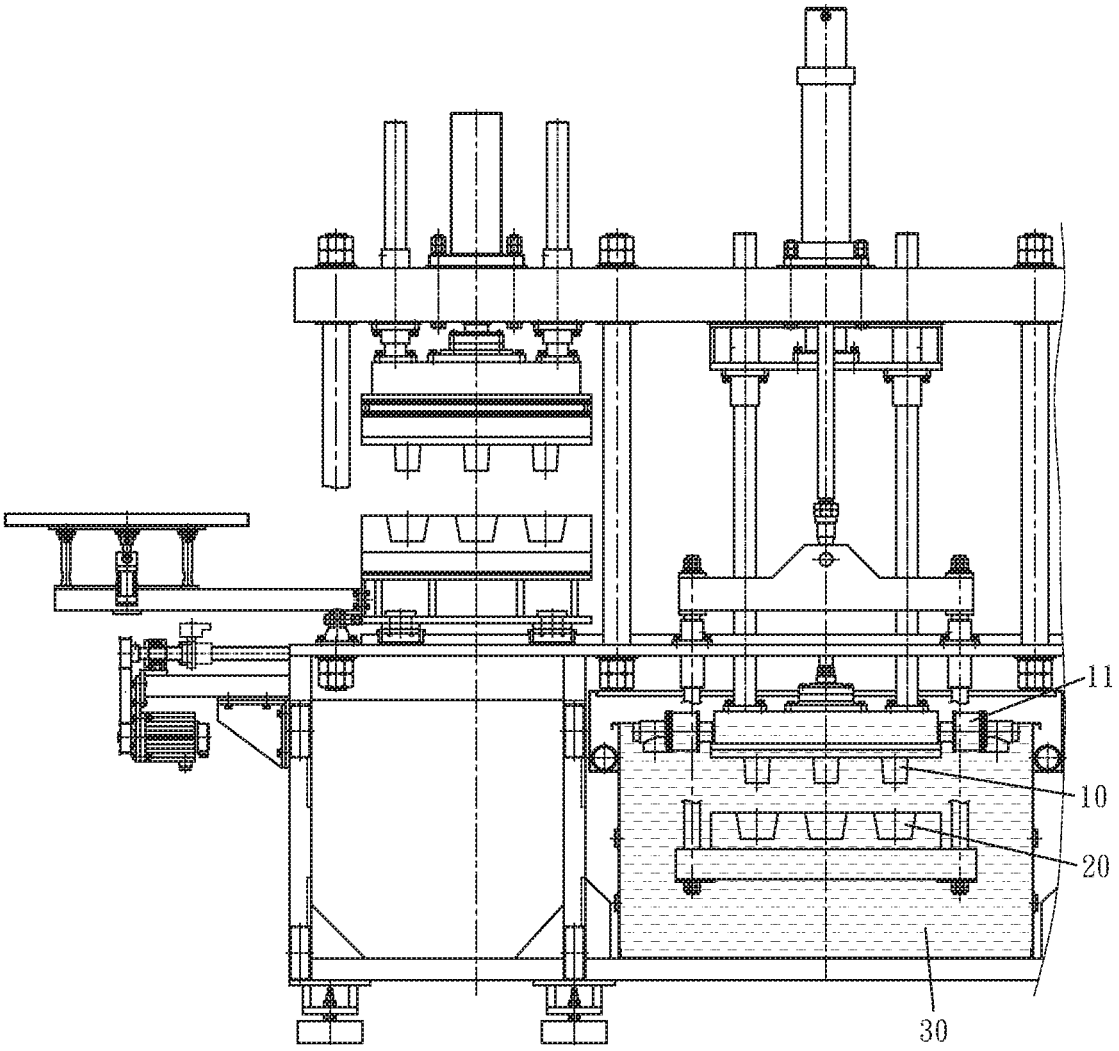
Figure 4:
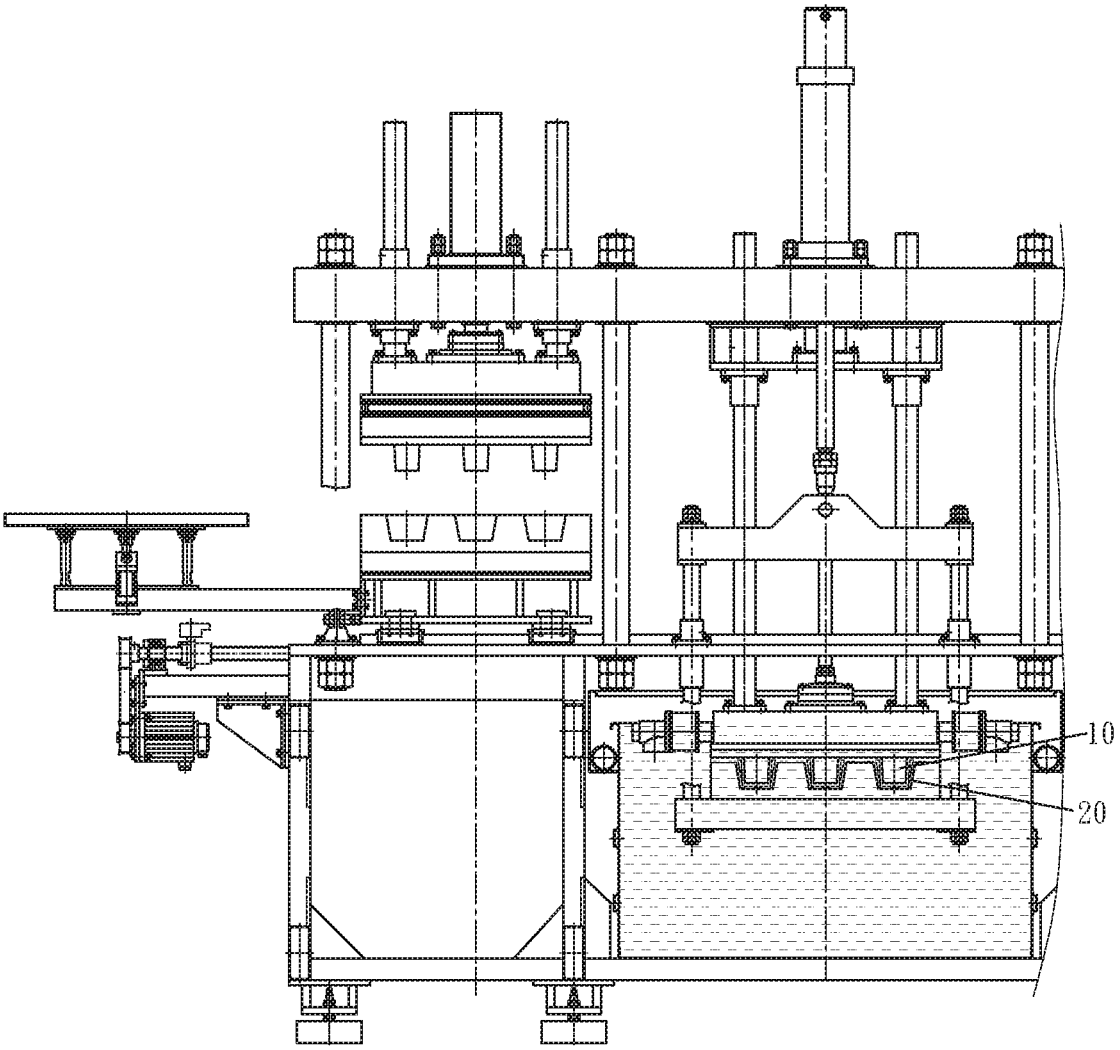
Figure 5:
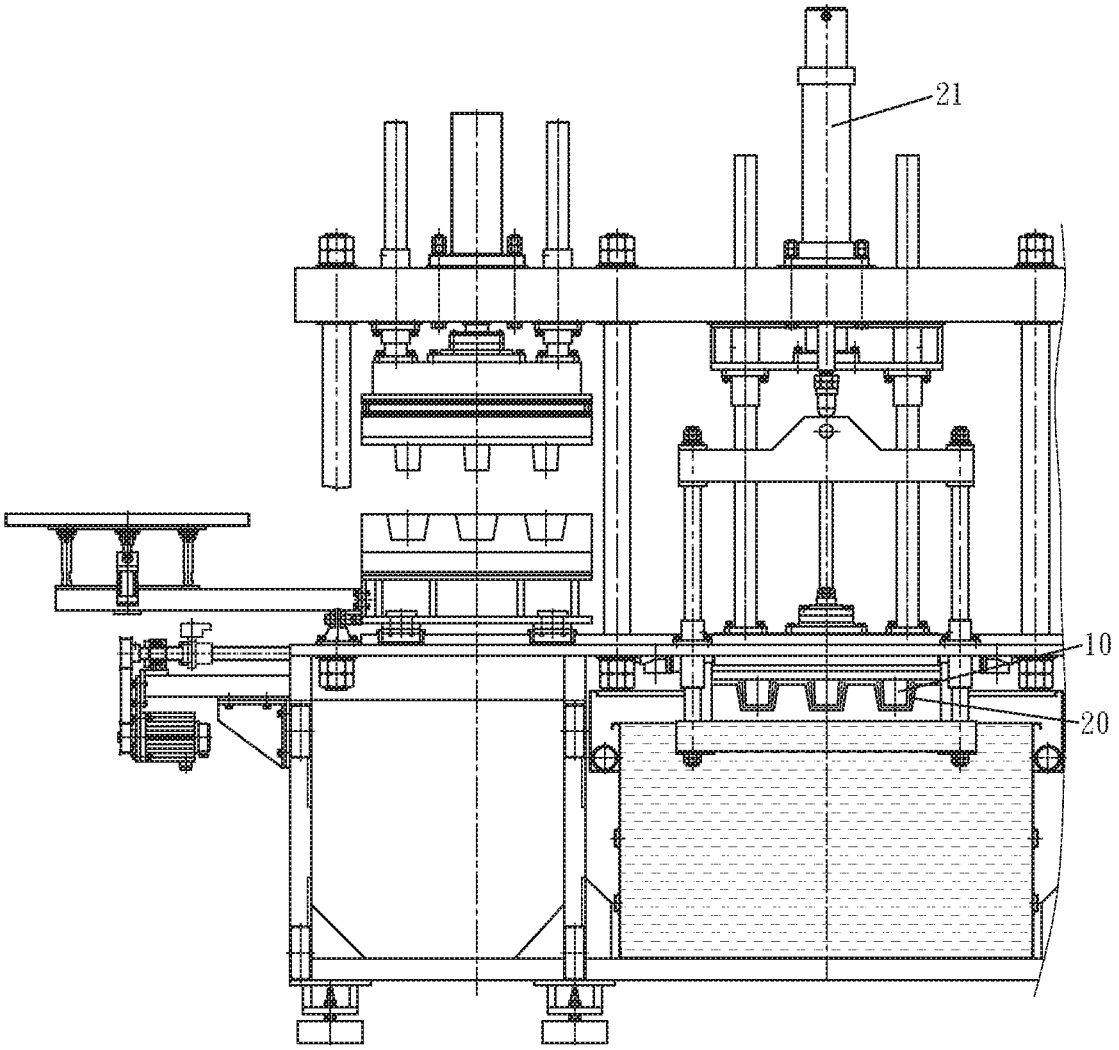
Figure 6:
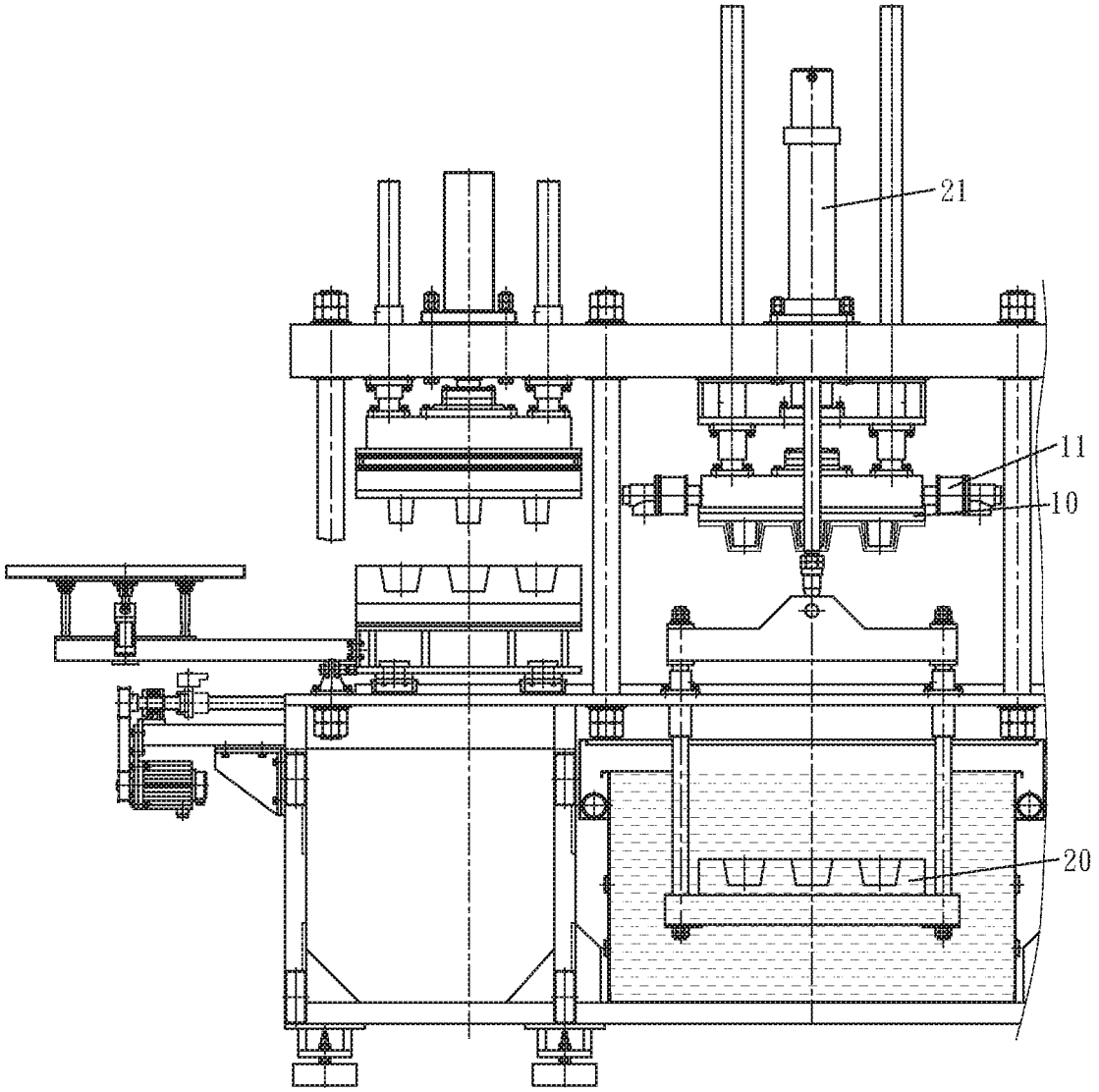
Figure 7:
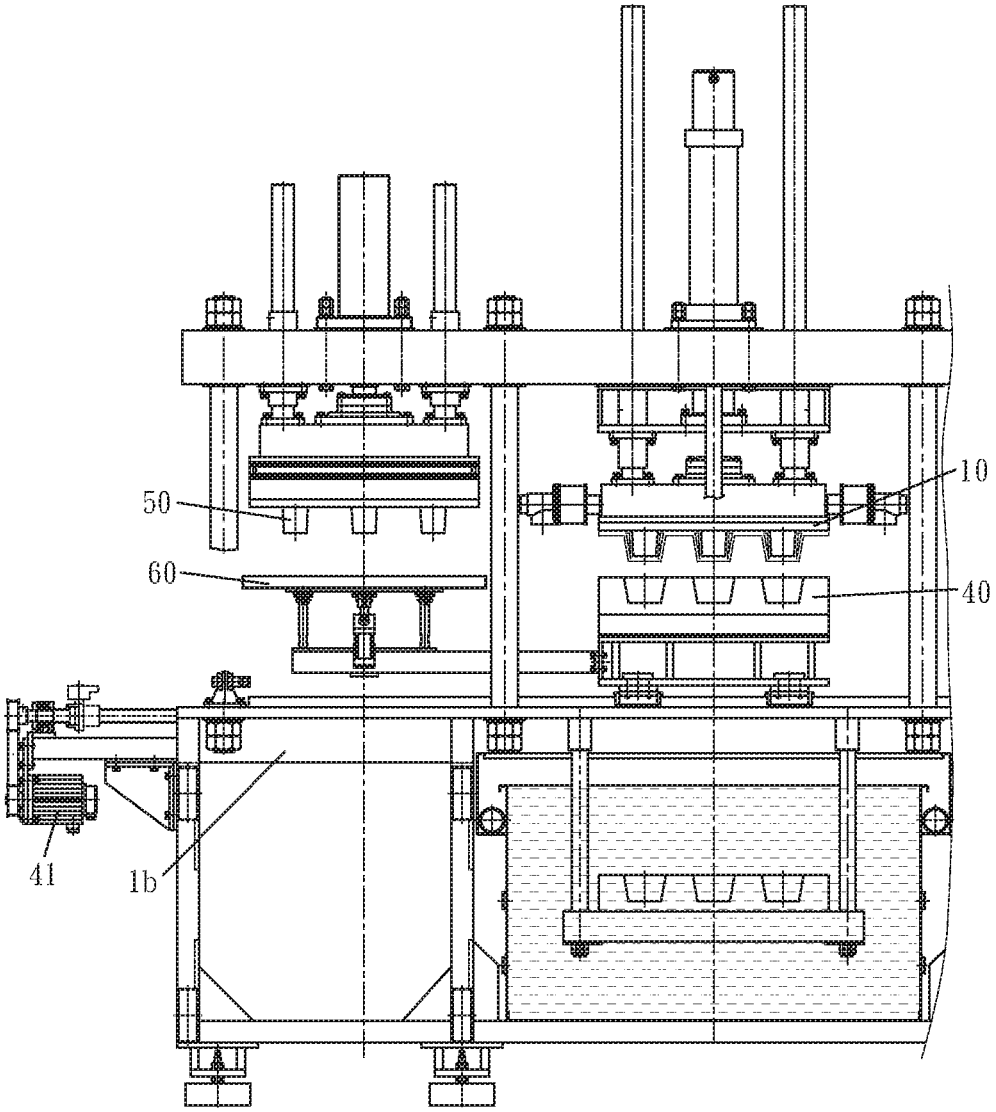
Figure 8:
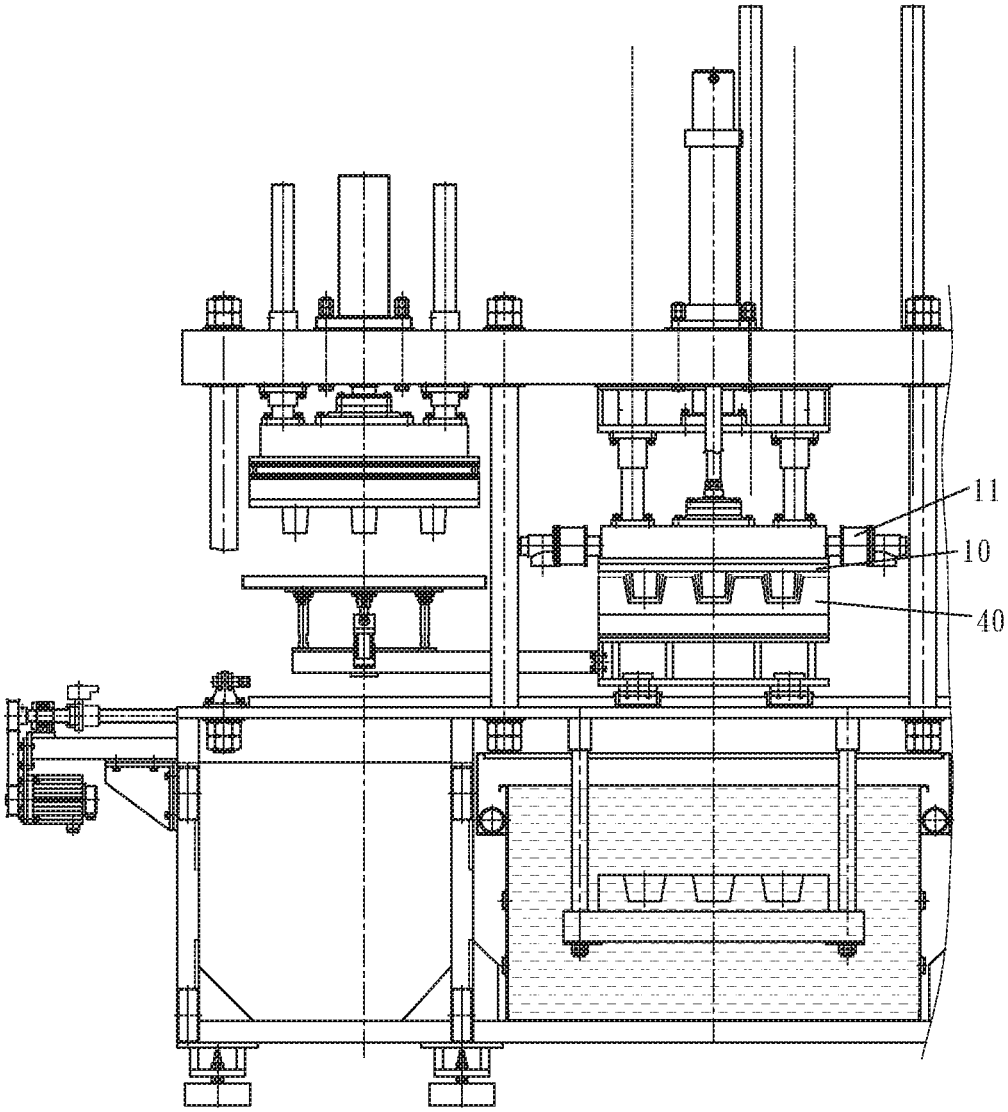
Figure 9:
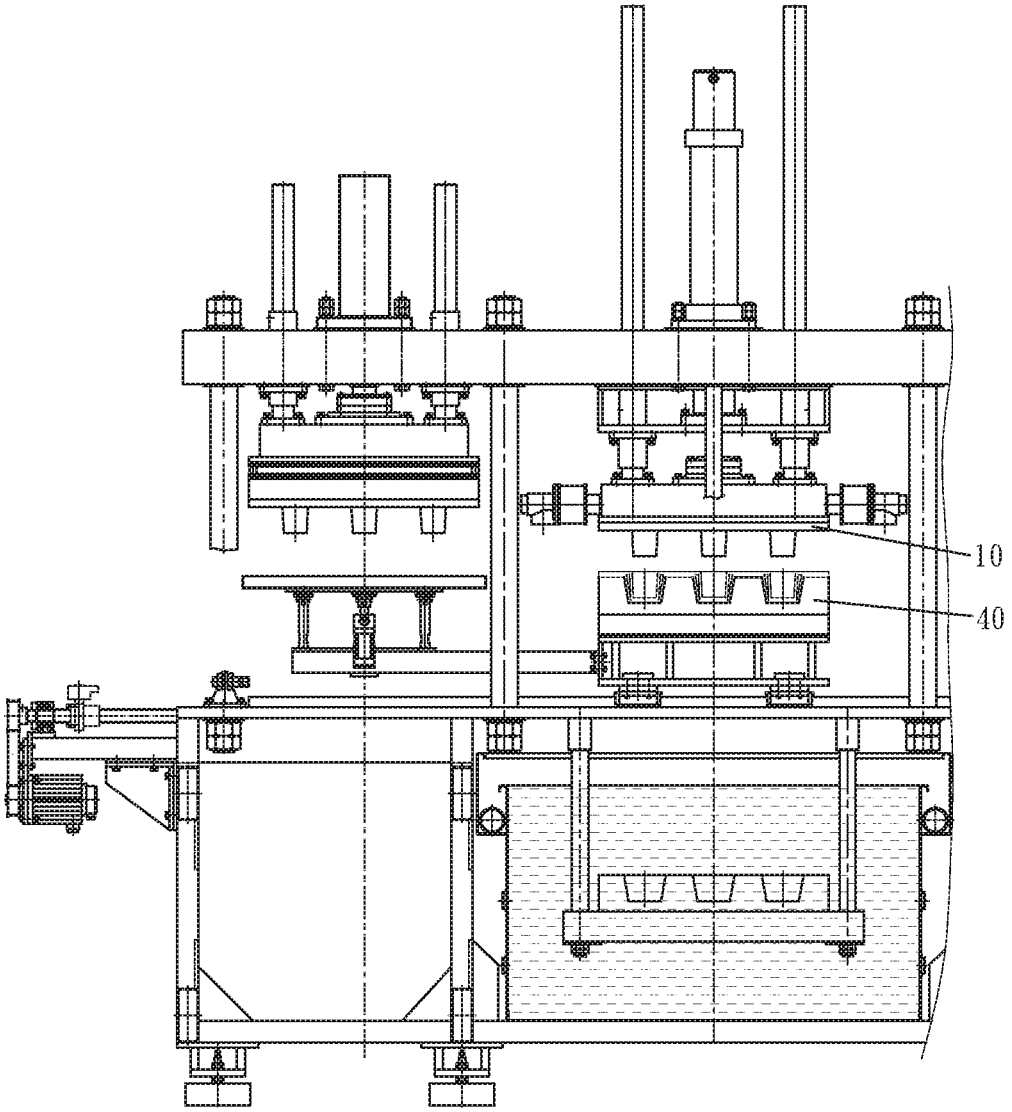
Figure 10:
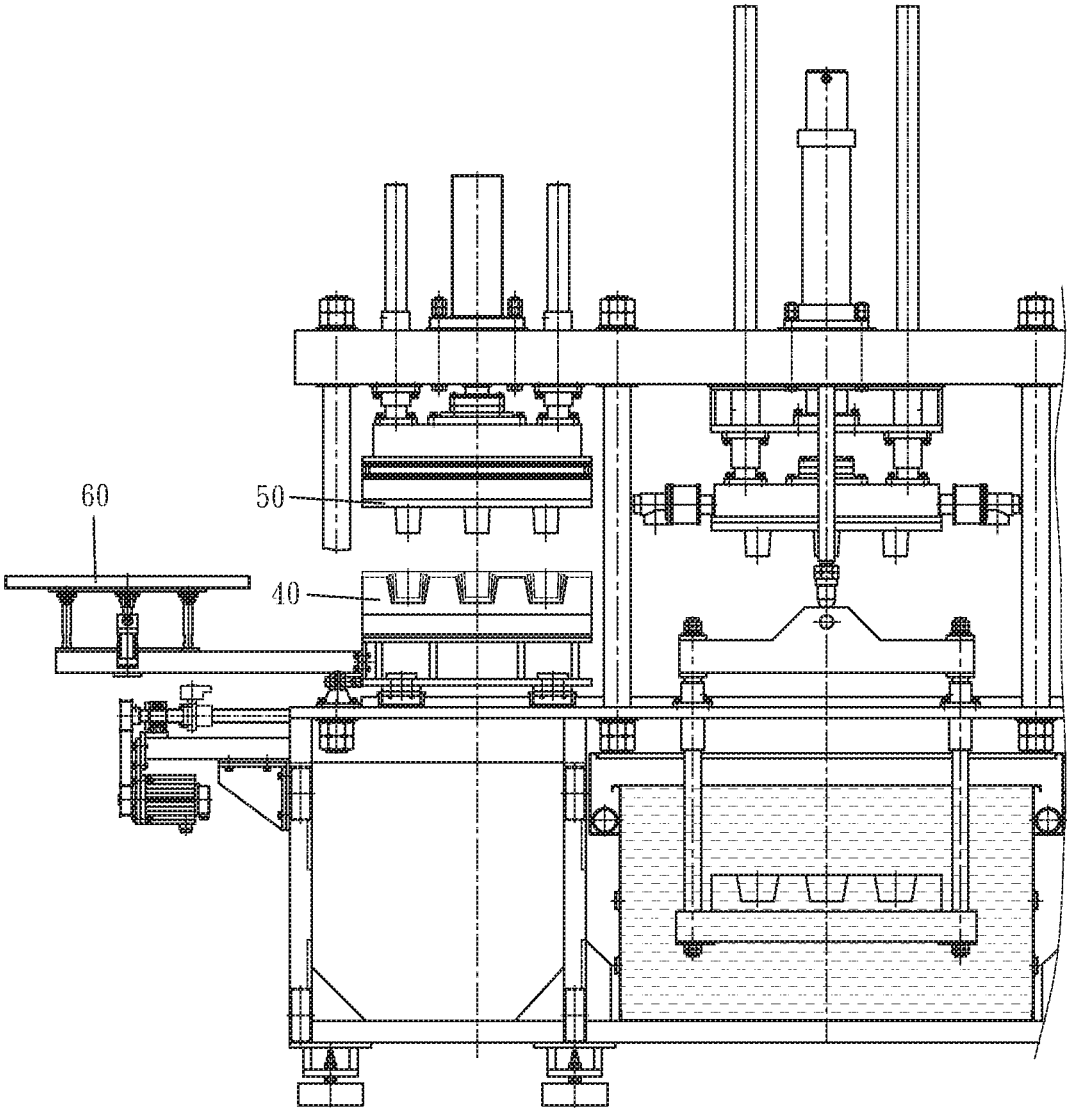
Figure 11:
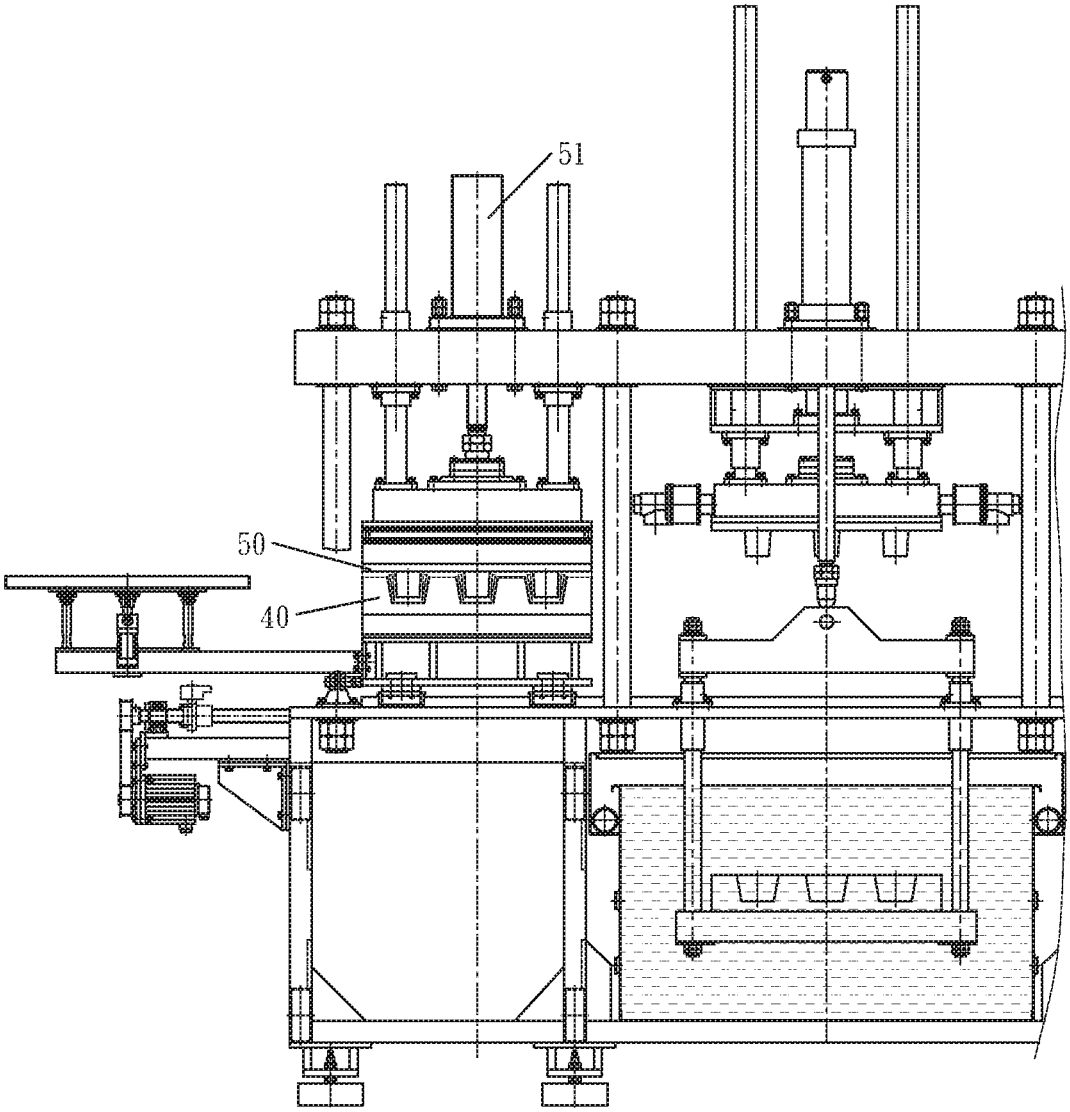
Figure 12:
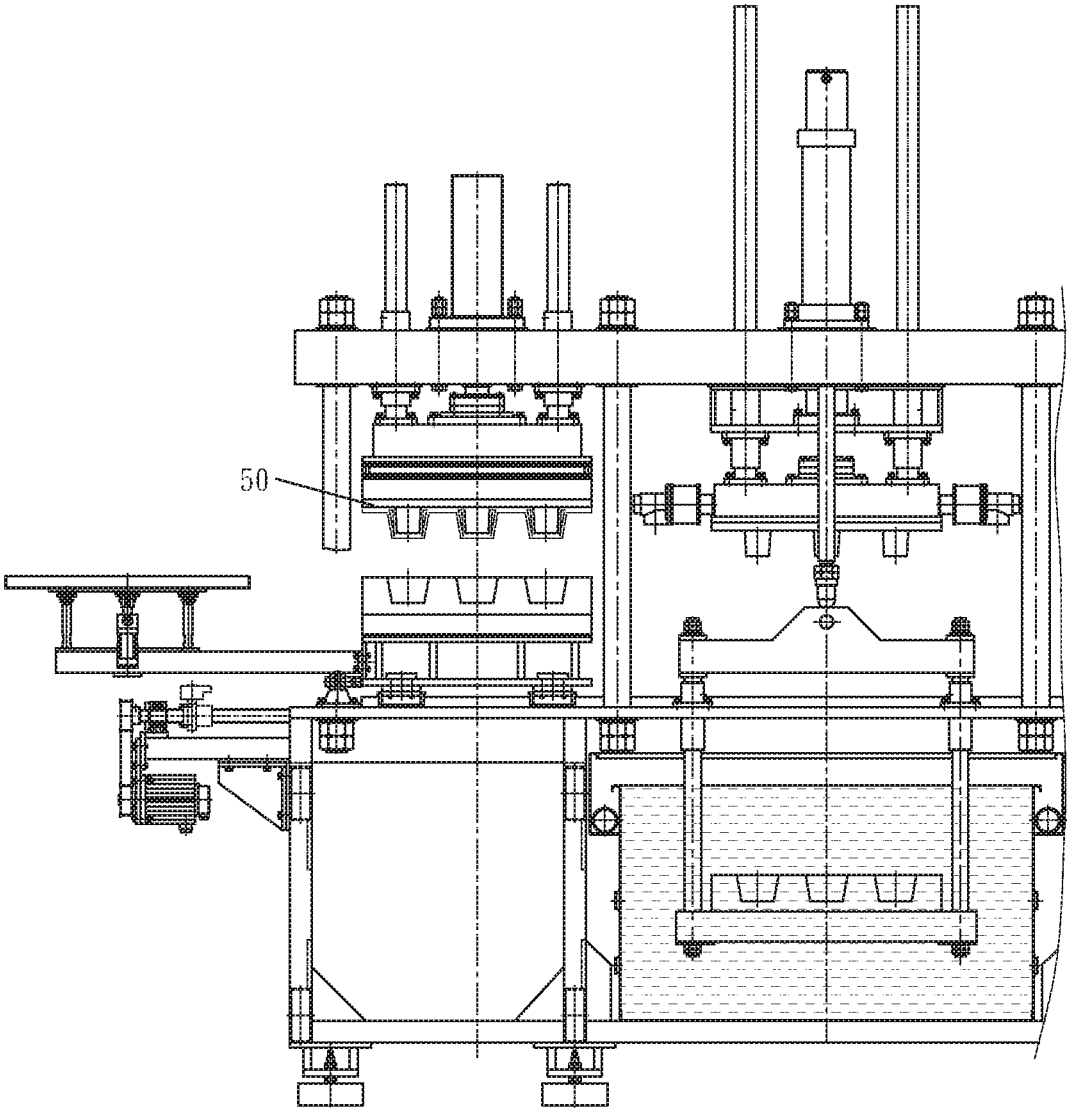
Figure 13:
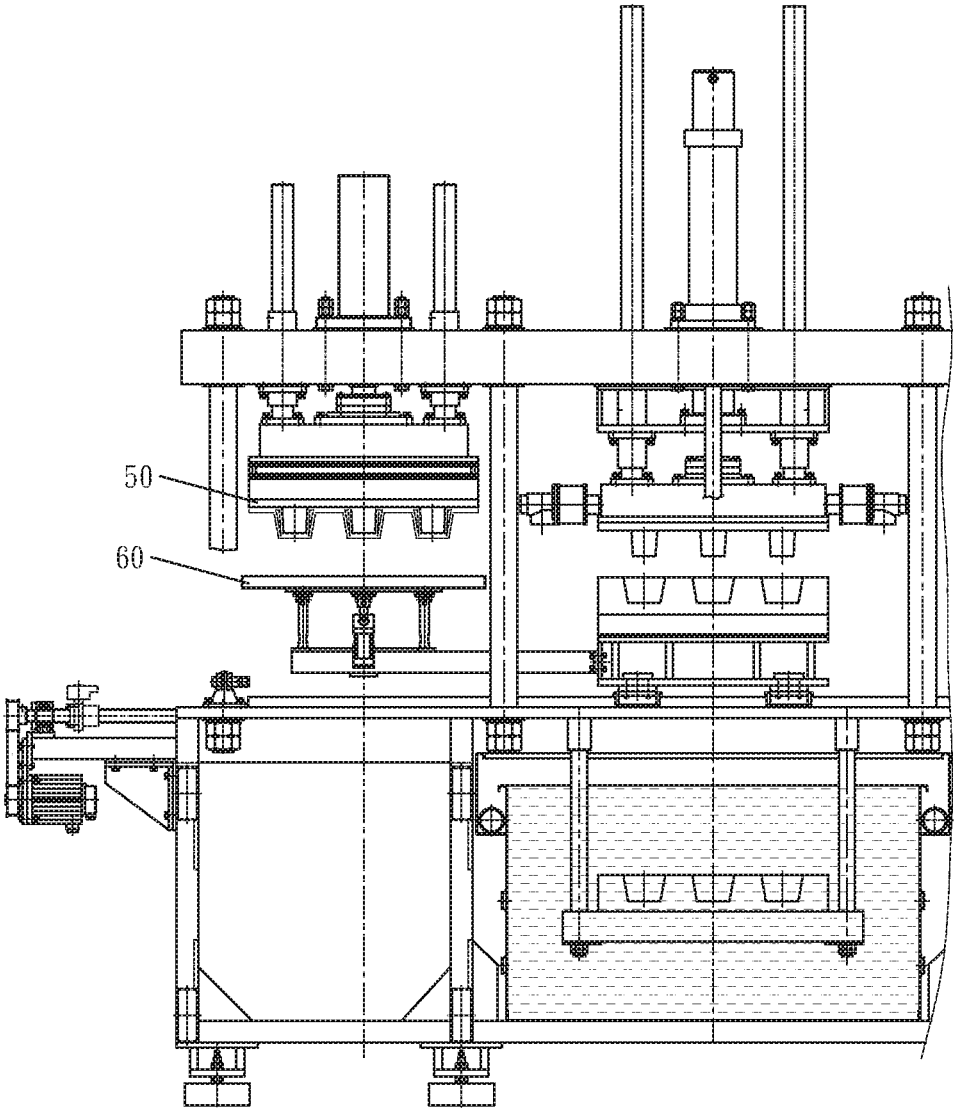
Figure 14:
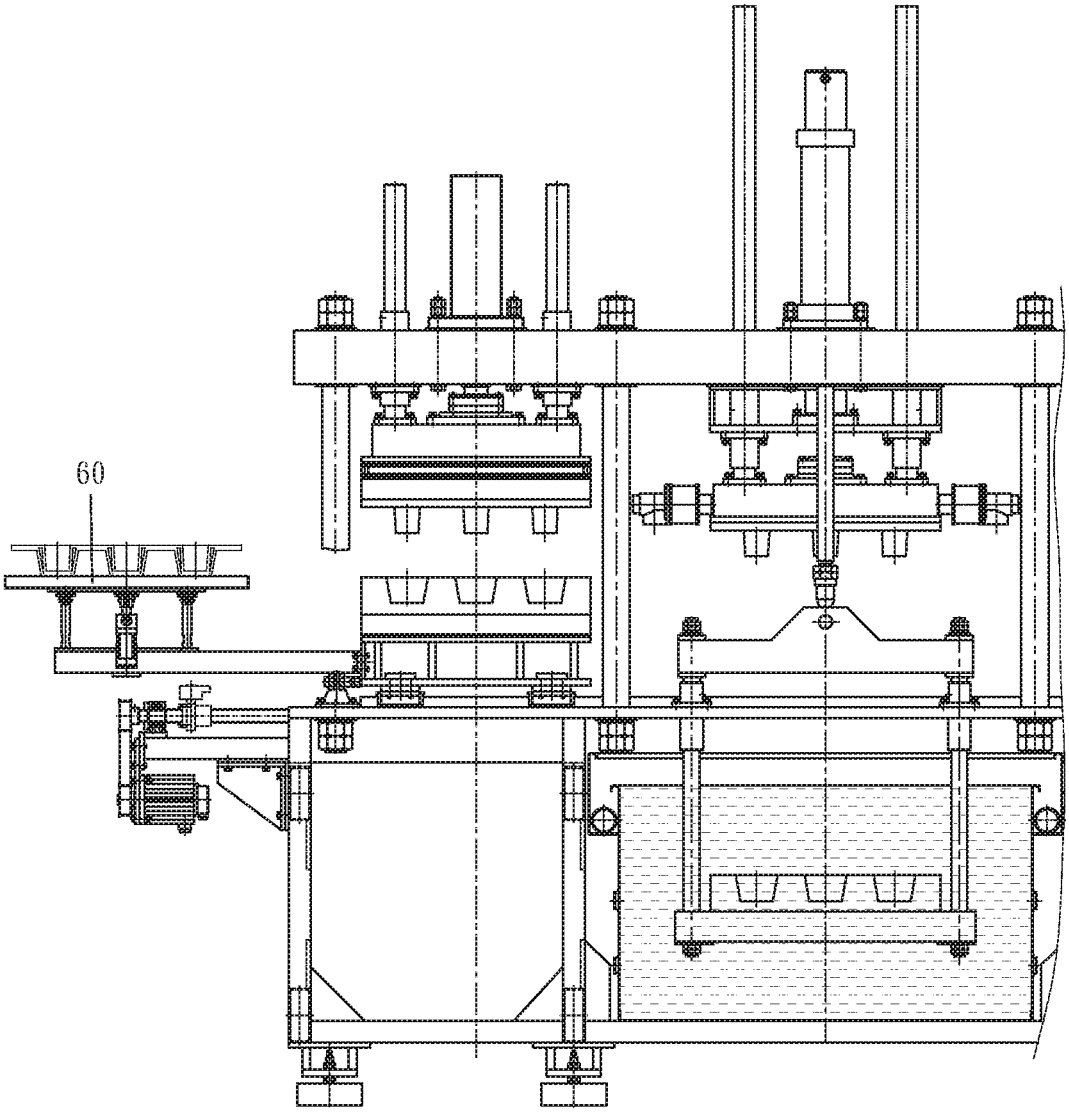

According to the composition of the above-described automatic molding machine 1, the manufacturing method of the molded product required by the present invention is subjected to the following steps, since the left side composition and the right side composition are the same in the present invention, and the same steps are performed, the following steps only select the left composition for illustration. The steps are as follows:

1. As shown in FIG. 2, the second power device 21 is firstly started to drive down the auxiliary frame 2*a*, and the lower pulp suction mold 20 is immersed into the pulp box 30;
2. As shown in FIG. 3, the first power device 11 is started to drive the upper pulp suction mold 10 into the pulp box 30, so that the upper pulp suction mold 10 and the lower pulp suction mold 20 are simultaneously immersed into the pulp box 30, then the first pumping device and the second pumping device are started to generate a pumping (vacuum) effect, so that the mold face of the upper pulp suction mold 10 and the mold face of the lower pulp suction mold 20 are simultaneously sucked to form a pulp layer separately;
3. As shown in FIG. 4, when the suction time is up, the upper pulp suction mold 10 is closed with the lower pulp suction mold 20, the lower pulp suction mold 20 can be pulled up and closed with the upper pulp suction mold 10 while the upper pulp suction mold 10 remains stationary, so that the pulp layer which are respectively adsorbed by the upper pulp suction mold 10 and the mold face of the lower pulp suction mold 20, which are combined to form a "formed blank". That is, the thickness of the formed blank after the combination of the pulp layer is twice that of the conventional single pulp layer;
4. As shown in FIG. 4, after the upper pulp suction mold 10 is closed with the lower pulp suction mold 20 to merge the two pulp layers into a formed blank, the second pumping device keeps the pumping (vacuum) action by the lower pulp suction mold 20, so as to adsorb the formed blank, but the first pumping device stops the pumping action, which is changed to the blowing (air supply) action, that is, the high-pressure gas is blown in, so that the formed blank begins to be dehydrated; in particular, the high-pressure gas that can be blown into the high heat accelerates the dehydration. During the process, the water inside the upper pulp suction mold 10 is discharged outward through the liquid outlet pipe connected inside the upper pulp suction mold 10, so as to dehydrate and dehumidify the formed blank;
5. When the formed blank begins to be dehydrated, as shown in FIG. 5, the second power device 21 drives upwards the lower pulp suction mold 20 together with the upper pulp suction mold 10 and the formed blank. The mold face of the lower pulp suction mold 20 is separated from the pulp surface, even if the formed blank leaves the pulp;
6. When the set dehydration time is up, as shown in FIG. 6, the first pumping device stops the blowing (air supply) action through the upper pulp suction mold 10, which is changed to the start pumping (vacuum) action, so as to adsorb the formed blank, while the second pumping device closes the pumping action by the lower pulp suction mold 20, which is changed to a blowing (air supply) action, so that the formed blank is separated from the lower pulp suction mold 20. Then, the first power device 11 drives the upper pulp suction mold 10 to adsorb the formed blank to rise together, and the second power device 21 drives down the lower pulp suction mold 20 into the pulp box 30;
7. Next, as shown in FIG. 7, the third power device 41 is started to push the lower hot pressing mold 40 of first side to move laterally along the lower frame 1*b* (to the right in the figure) and stop at the corresponding position of the upper pulp suction mold 10. During the process, the receiving tray 60 of the first side moves laterally along with the lower hot pressing mold 40 of first side (to the right in the figure), and will stay under the upper hot pressing mold 50 of first side;
8. Next, as shown in FIG. 8, the first power device 11 is started to push down the upper pulp suction mold 10 to be correspondingly closed with the lower hot pressing mold 40 of first side, and then the third pumping device generates a pumping (vacuum) action through the lower hot pressing mold 40 of first side, so as to adsorb the formed blank, while the first pumping device closes the pumping action through the upper pulp suction mold 10, which is changed to a blowing (air supply) action, so that the formed blank is separated from the upper pulp suction mold 10;
9. Next, as shown in FIG. 9, the upper pulp suction mold 10 is driven to rise, so the formed blank is adsorbed on the lower hot pressing mold 40 of the first side, during the process, the formed blank is continuously dehydrated and dehumidified;
10. Next, as shown in FIG. 10, the lower hot pressing mold 40 of the first side is driven to move laterally outward (to the left in the figure) along the lower frame 1*b*, and returned to stop at the lower position corresponding to the upper hot pressing mold 50 of the first side. In the process, the receiving tray 60 of the first side is of course moved laterally back to the outer side synchronously along the lower hot pressing mold 40 of the first side;
11. Next, as shown in FIG. 11, the fourth power device 51 is started to drive down the upper hot pressing mold 50 of the first side to be closed with the lower hot pressing mold 40 of the first side, and the formed blank is hot-pressed and shaped, which is fully dehydrated into the finished product of the molded product. When the set hot pressing and shaping time is up, heating the lower hot pressing mold 40 of the first side and the upper hot pressing mold 50 of the first side is stopped. Then, the fourth pumping device starts the pumping (vacuum) action through the upper hot pressing mold 50 of the first side, so as to adsorb the finished product of the molded product, while the third pumping device starts the blowing (air supply) action through the lower hot pressing mold 40 of the first side, so that the finished product of the molded product is separated from the lower pulp suction mold 20;

12. Next, as shown in FIG. 12, the upper hot pressing mold 50 of the first side adsorbs the finished product of the molded product, which are jointly driven to rise back;

13. Next, as shown in FIG. 13, the receiving tray 60 of the first side is driven and moved to the lower side of the upper hot pressing mold 50 of the first side in the next process (i.e., as described in Step 7), the fourth pumping device stops the pumping action through the upper hot pressing mold 50 of the first side, which is changed to the blowing (air supply) action, so that the finished product of the molded product is blown down and received by the receiving tray 60 of the first side;

14. Next, as shown in FIG. 14, the receiving tray 60 of the first side is driven to move laterally back to the outer side synchronously in next process (i.e., as described in Step 10), and the finished product of the molded product is also driven to move outwards, so it can be taken away and collected separately by the receiving tray 60 of the first side; the action of taking away the finished product of the molded product can be done by an automatic machine (such as a robot arm), or by hand.

As described above, the automatic molding machine 1 of the present invention can be composed of the lower hot pressing mold 40 of the first side, the upper hot pressing mold 50 of the first side and the receiving tray 60 of the first side as well as the lower hot pressing mold 70 of the second side, the upper hot pressing mold 80 of the second side and the receiving tray 90 of the second side, which are divided into two sides of the whole automatic molding machine 1 (left side and right side). Therefore, when the middle part completes the sucking pulp and closing mold (the first formed blank is produced) and then transferred to the left part for the hot pressing and shaping, the middle part can continue to complete another sucking pulp and closing mold (the second formed blank is produced), which is then transferred to the right part for hot pressing and shaping, wherein the hot pressing and shaping of the different process is alternately performed on the two sides (left side and right side), so that the manufacturing the finished product of molded products can be accelerated.

It should also be mentioned that when the hot pressing and shaping is completed at the same side (whether the left side or the right side), and then the receiving tray of this side is moved to the lower side of the upper hot pressing mold at the same side, the lower pulp suction mold at the same side will also move just to the lower side of the upper suction mold to stop, so when the receiving tray is receiving the finished product of the molded product, the upper suction mold can also transfer the second formed blank in the next process to the lower hot pressing mold, and then, when the receiving tray is moved outwards back to the position, the lower hot pressing mold adsorbs the formed blank and returns to the lower side of the upper hot pressing mold to stop, so the materials are taken from the receiving tray while the upper hot-pressing mold and the lower hot-pressing mold simultaneously carry out the hot pressing and shaping of the second formed blank, wherein the alternating process can accelerate the manufacturing of the finished product of the molded product.

Figure 15:
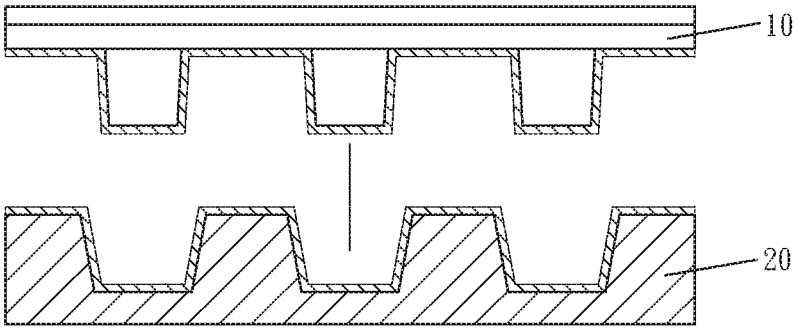
FIG. 15 is a schematic diagram of the present invention wherein the upper and lower pulp suction molds simultaneously suck pulp to form upper and lower pulp layers.

A further requirement of the present invention is to manufacture a finished product of a molded product by using the automatic molding machine 1 according to the steps of the above manufacturing method. In the process, the thickness of the finished product of the molded product can be increased and also the internal space of the finished product of the molded product can be increased, so as to enhance the cushioning effect. Please refer to FIG. 15, described as above Step 2, in the pulp box 30, the pulp is sucked simultaneously by the upper pulp suction mold 10 and the lower pulp suction mold 20, the upper and lower pulp layers are separately formed, wherein the fine metal mesh provided in the upper pulp suction mold 10 and the fine metal mesh provided in the lower pulp suction mold 20 are same or different in shape and position, that is, the shape of the upper and lower fine metal mesh can be said to be similar, but some parts will have positional differences.

Figure 16:
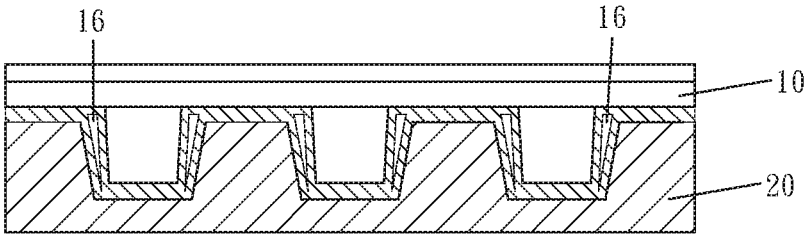
FIG. 16 is a schematic diagram of the present invention wherein the upper and lower pulp suction molds are closed to combine the upper and lower pulp layers into a formed blank.

Then, as shown in FIG. 16, when the upper pulp suction mold 10 is closed with the lower pulp suction mold 20 as described in the foregoing Step 3, the single pulp layer originally adsorbed respectively by the upper pulp suction mold 10 and the lower pulp suction mold 20 is merged into a formed blank which is doubled in thickness. At this time, it can be seen that there is the plural space 16 in the formed blank, which is the single pulp layer originally adsorbed respectively by the upper pulp suction mold 10 and the lower pulp suction mold 20, the partial parts of the shape of two fine metal meshes are different in position, and therefore the same space 16 exists in the formed blank after the molds are closed.

Figure 17:
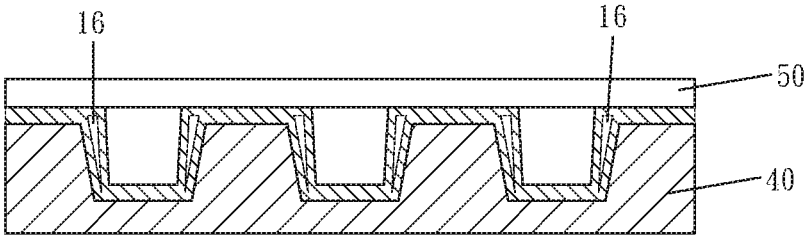
FIG. 17 is a schematic diagram of the present invention with the formed blank formed by closing the hot-pressed upper mold wherein the hot-pressed lower mold is hot-pressed and shaped into the finished product of the molded product.
Figure 18:
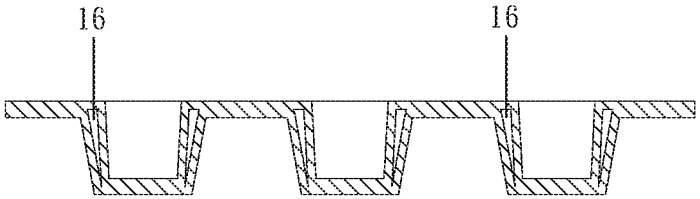
FIG. 18 is a transverse sectional view of the present invention illustrating the finished product of the molded product with internal space.

Then, as shown in FIG. 17, when the upper hot pressing mold 50 of the first side is lowered and closed with the lower hot pressing mold 40 of the first side as described in the foregoing Step 11, and the formed blank is hot pressed and shaped, the formed blank will be quickly dehydrated into the finished product of the molded product, and finally, after demolding and taking the material, the finished product of the molded product is as shown in FIG. 18, and also the plural space 16 of course exists.

In summary, the present invention has the following excellent effects in use;

1. The present invention is designed that both of the upper pulp suction mold and the lower pulp suction mold simultaneously suck the pulp and are closed in the pulp box to speed up the manufacturing speed; the structural design is not available in any conventional molded product manufacturing machine.

2. The formed blank of the present invention is formed in the process, the upper pulp suction mold and the lower pulp suction mold suck the pulp in the pulp box and then the closed mold is done, so the formed blank can increase the thickness to improve the shock absorber effect of overall finished product; and also, the present invention can be selected according to the size design, and when the upper pulp suction mold and the lower pulp suction mold are correspondingly disposed, the same parts with the shape and position are fitted, but the dissimilar parts with position are not fitted, so there is a certain space inside the finished product of the molded product, so as to enhance the shock absorber and cushioning effect.

3. The formed blank of the present invention is formed in the process, the upper pulp suction mold and the lower pulp suction mold suck the pulp in the pulp box and then the closed mold is done, because the outer surface is closely adhered to the fine metal mesh, the excellent surface is formed, so the outer surface of the finished product of the final molded product is smooth, which is enough to enhance the overall value of the packaged goods.

In summary, the present invention has the absolute novelty and practical progressiveness assuredly, therefore the patent for invention is applied according to law, and I earnestly request that the patent of this case can be approved as soon as possible after examination, and it is really sensible.

What is claimed is:

1. An automatic molding machine for molded products, comprises:

an upper pulp suction mold erected on an upper frame and configured to be lifted and lowered by a first power device, wherein a mold face of the upper pulp suction mold faces downward, and the upper pulp suction mold is connected with a first pumping device, and is configured to receive a pumping or blowing action of the first pumping device;

a lower pulp suction mold erected on an auxiliary frame, wherein the auxiliary frame is configured to be lifted and lowered together with the lower pulp suction mold by a second power device, and a mold face of the lower pulp suction mold faces upward, wherein the lower pulp suction mold is located under the upper pulp suction mold, and the lower pulp suction mold is connected with a second pumping device, and is configured to receive a pumping or blowing action of the second pumping device;

a pulp box disposed under the lower pulp suction mold, the pulp box having an internal space for receiving pulp, and a top opening configured to receive the mold surface of the lower pulp suction mold and the mold surface of the upper pulp suction mold, wherein the lower pulp section mold and the upper pulp suction mold are immerged in the pulp;

at least one lower hot pressing mold erected on a lower frame and configured to be laterally moved by a third power device, the at least one lower hot pressing mold located at one side of the upper pulp suction mold, and a height of the lower hot pressing mold is between the upper pulp suction mold and the lower pulp suction mold, and wherein when the at least one lower hot pressing mold is pushed to move laterally, the at least one lower hot pressing mold is at a corresponding position under the upper pulp suction mold, and wherein the lower hot pressing mold is connected with a third pumping device, and is configured to receive a pumping or blowing action of the third pumping device;

at least one upper hot pressing mold erected on the upper frame and configured to be lifted and lowered by a fourth power device, the upper hot pressing mold located at one side of the upper pulp suction mold and above the lower hot pressing mold, wherein the upper hot pressing mold is configured to be closed with the at least one lower hot pressing mold when lowered, and the at least one upper hot pressing mold is connected with a fourth pumping device, and is configured to receive a pumping or blowing action of the fourth pumping device; and at least one receiving tray located outside the at least one lower hot pressing mold, wherein the receiving tray is connected with the lower hot pressing mold and is configured to synchronously move laterally with the at least one lower hot pressing mold.

2. The automatic molding machine for molded products of claim 1, wherein the first pumping device is configured to blow a high pressure gas.

3. The automatic molding machine for molded products of claim 2, wherein the first pumping device is configured to blow the high pressure gas with high heat.

4. The automatic molding machine for molded products of claim 1, wherein the upper pulp suction mold is internally connected with a liquid outlet pipe.

5. The automatic molding machine for molded products of claim 1, wherein the first pumping device is configured to blow a high pressure gas with high heat.

* * * * *